US006260767B1

(12) United States Patent
Nissinen et al.

(10) Patent No.: US 6,260,767 B1
(45) Date of Patent: Jul. 17, 2001

(54) NOZZLE APPARATUS IN A SPRAY COATING STATION AND A METHOD FOR CHANGING THE MOUTHPIECE

(75) Inventors: Vilho Nissinen, Numminen (FI); Jukka Linnonmaa, Appleton, WI (US); Mika Vähäkuopus, Järvenpää (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/508,020

(22) PCT Filed: Sep. 7, 1998

(86) PCT No.: PCT/FI98/00695

§ 371 Date: Mar. 6, 2000

§ 102(e) Date: Mar. 6, 2000

(87) PCT Pub. No.: WO99/12655

PCT Pub. Date: Mar. 18, 1999

(30) Foreign Application Priority Data

Sep. 8, 1997 (FI) ..... 973629

(51) Int. Cl.[7] ..... B05B 17/00; A62C 31/02

(52) U.S. Cl. ..... 239/1; 239/390; 239/391; 239/600; 29/402.08

(58) Field of Search ..... 239/390, 391, 239/600; 29/402.08; 162/269, 272

(56) References Cited

FOREIGN PATENT DOCUMENTS

WO97/13035 4/1997 (WO) .

OTHER PUBLICATIONS

Abstract of JP 5154428 Toshiba KK Jun. 22, 1993.

Abstract of JP 6112638 Sanyo Electric Co. Ltd. Apr. 22, 1994.

Abstract of JP 7185426 Mattsushita Denki Sangyo KK Jul. 25, 1995.

*Primary Examiner*—David A. Scherbel
*Assistant Examiner*—Steven J. Ganey
(74) *Attorney, Agent, or Firm*—Cohen, Pontani, Lieberman & Pavane

(57) ABSTRACT

The present invention relates to a nozzle device for use in a spray coating station designed for coating a paper or board web, said device comprising a nozzle device body (1), a replaceable nozzle piece (2) and clamping member and actuator (3,4) suited to lock said nozzle piece (2) to said nozzle device body (1). New nozzle pieces (2) are stored in a nozzle replacement apparatus (5,6) which facilitates rapid replacement of an in-use nozzle piece (2). In the replacement operation, the clamping member and actuator (3,4) serving to lock said nozzle piece (2) are first actuated in order to release said nozzle piece whereafter the worn nozzle piece (2) is removed with the help of transfer member (6) and a new nozzle piece (2) is moved to the nozzle device, and finally said new nozzle piece (2) is locked by said clamping member and actuator (3,4) to said nozzle device body (1).

13 Claims, 3 Drawing Sheets

NOZZLE APPARATUS IN A SPRAY COATING STATION AND A METHOD FOR CHANGING THE MOUTHPIECE

FIELD OF THE INVENTION

The present invention relates to a nozzle device comprising at least a nozzle device body with a nozzle orifice located therein. Such nozzle devices are used in spray coating stations designed for coating a paper or board web, whereby a single coating station may include up to hundreds of nozzles.

The invention also concerns a method for replacing a nozzle piece in the nozzle device of a spray coating station.

BACKGROUND OF THE INVENTION

Coating of paper by means of high-pressure coat jets is described in patent applications PCT/FI96/00525 and PCT/FI96/00526. Conventionally, the nozzle used in spray coating is made from a wear-resistant material such as a ceram or ceram-clad steel, for instance. The function of the nozzle is to atomize the ejected coat jet into an aerosol and then to direct this aerosol to the surface of the web being coated. Hence, the nozzle must be capable of spraying the coat in a homogeneous and all-covering manner in order to achieve a high-quality and homogeneous layer of the applied coat.

The coat formulation contains a lot of clay or other solids and the pressure levels employed at the nozzle are high. For instance, the solids may be in the range of about 40–60% and the operating pressure in the order of 100–200 bar (10–20 MPa). Hence, the wear of the nozzle orifices is rapid and their replacement must be performed at short intervals notwithstanding the fact that they are made from the most wear-resistant materials. In the prior art, it has been necessary to replace the entire nozzle which is a clumsy and time-consuming operation. Moreover, the replacement has typically been necessary for a large number of nozzles simultaneously.

For reasons of efficient production, the nozzle parts should be replaceable without stopping the ongoing coating and affecting the coat quality in a noticeable manner. This need requires that the nozzles must be replaceable in small batches, preferably individually. Hence, the replacement of nozzles could be staggered between the nozzles of the coating station, thus assuring smooth and uninterrupted coating despite the nozzle replacements. However, this requirement cannot be fulfilled by conventional techniques or equipment.

SUMMARY OF THE INVENTION

It is an object of the present invention to provide a novel type of nozzle device and method for the replacement of nozzle pieces in modern nozzle assemblies. In this fashion, the above-described drawbacks of conventional techniques can be overcome.

The goal of the invention is achieved by making the nozzle orifice, which is particularly subject to wear, in a separate, replaceable part hereafter called a nozzle piece. After the nozzle orifice has reached an excessive degree of wear, the performance of the nozzle can be restored by replacing merely the nozzle piece instead of dismounting the entire nozzle assembly. Easy replacement of the nozzle pieces is attained by mounting them, e.g., on a band or plate. The nozzle device is provided with elements serving to retain the nozzle piece in place and elements sealing the nozzle piece against the nozzle device body, the elements having a design favouring easy dismounting and remounting. Additionally, the nozzle device is provided with dedicated nozzle piece changeover means.

More specifically, the nozzle device according to the invention comprises a nozzle device body, replaceable nozzle pieces having nozzle orifices, a clamping means for locking the nozzle pieces to the nozzle device body, and a nozzle piece replacement apparatus having a plurality of nozzle pieces, the apparatus being suitable for facilitating rapid replacement of nozzle pieces. The nozzle device body has a surface which is adapted to mate under a compressive force with a surface of the nozzle piece. The clamping means has a clamp member adapted to compress the nozzle piece tightly against the nozzle device body. The clamp member has a surface configured to mate with a surface of the nozzle piece. The clamping means also has an actuator means adapted to produce a force capable of pushing the clamp member toward the nozzle device body and also of separating the clamp member and the nozzle device body so that the nozzle piece may be replaced.

Furthermore, the method according to the invention for nozzle piece replacement is characterized by what comprises removing the nozzle piece from the nozzle device body by releasing the compressive force exerted by the clamp member so that the mating surfaces of the clamp member and the nozzle piece move apart, the released nozzle piece is transferred away from the nozzle device body, a replacement nozzle piece is moved into position, and the replacement nozzle piece is locked to the nozzle device body by compressing the nozzle piece against the nozzle device body with the clamp member.

The invention offers significant benefits.

The nozzle device according to the invention facilitates rapid and remote-controlled replacement of nozzle orifice. By virtue of equipping a spray coating station with nozzle devices according to the invention, it will be possible to produce a high-quality coat in a continuous run also when using spray coating techniques. By virtue of utilizing the novel nozzle devices as disclosed in the method according to the invention, the nozzles of a spray coating station can be replaced in a staggered manner, whereby the replacement of one nozzle or a few nozzles at a time does not affect coat quality in coating stations having a plurality of nozzle rows adapted to operate downstream in parallel, whereby the jets of the individual nozzles will partially overlap each other also in the cross-machine direction.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the following, the invention will be examined in greater detail by making reference to exemplifying embodiments and appended drawings in which.

DETAILED DESCRIPTION OF THE PRESENTLY PREFERRED EMBODIMENTS

Figure 1:
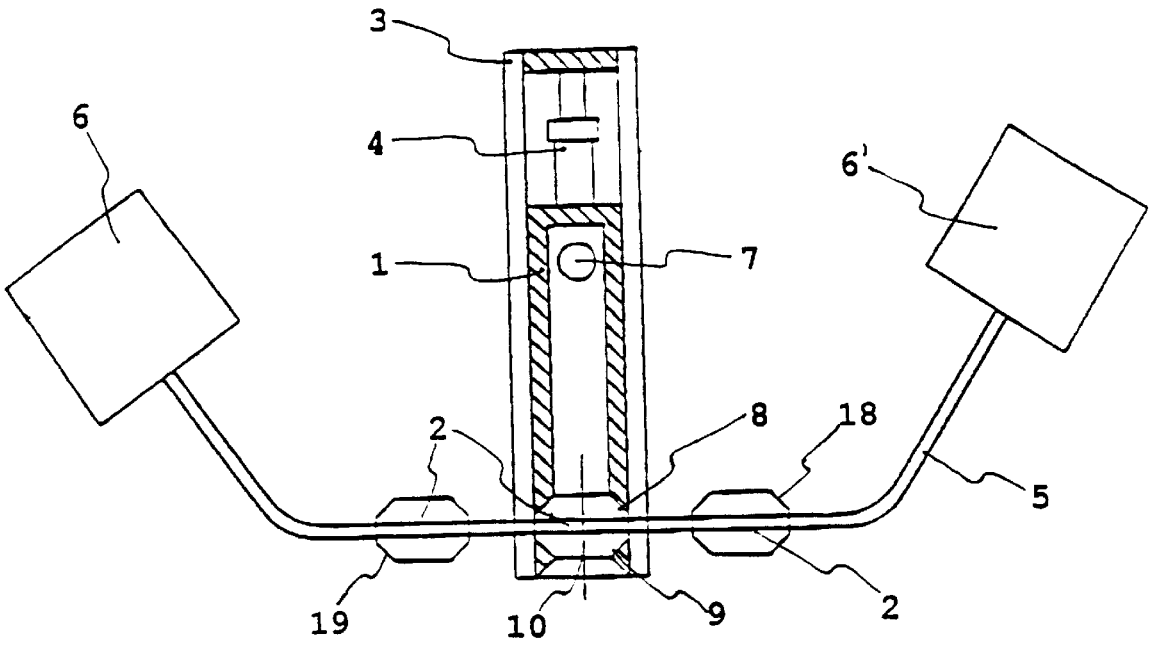
FIG. 1 shows in a partially sectional view a first embodiment of the nozzle device according to the invention for use in the coating of a paper or board web in a spray coating station.
Figure 2:
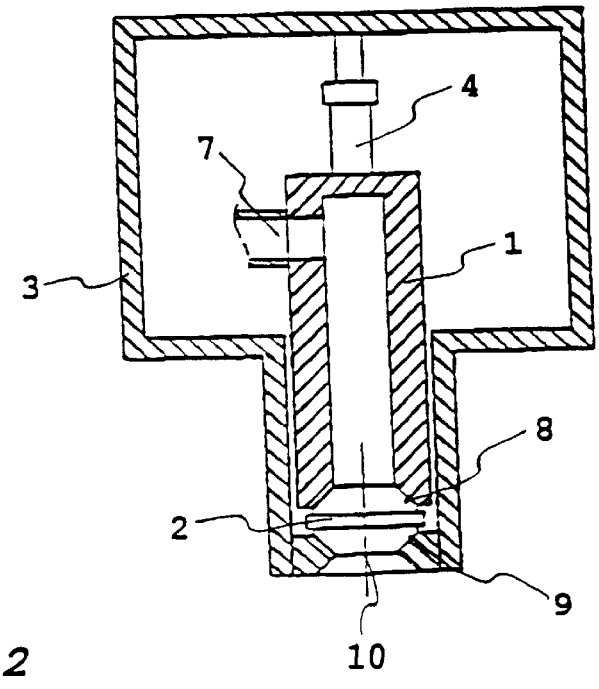
FIG. 2 shows a side view of the nozzle device of FIG. 1.

Referring to FIGS. 1 and 2, the nozzle device shown therein comprises a device body 1, nozzle pieces 2 mounted on a nozzle piece carrier band 5, a clamp member 3, a clamp actuator 4 and transfer means 6 of the carrier band 5. The nozzle device is mounted on the spray coating station structures via its body 1, however, with the exception of the band transfer means 6 which may be mounted on their dedicated transfer means support in the coating station. Reference in the description is made to a nozzle device mounted as in FIGS. 1 and 2 to directions in such a design. Obviously, the nozzle device can be used mounted at any angle with regard to the horizontal plane, for instance, so that the jet is directed straight upright.

The nozzle device body 1 is hollow with a channel and nozzle 7 therein for passing the coating into the interior of the nozzle device body and therefrom further to the nozzle piece 2. The lower part of the body 1 includes a sealing seat surface 8, which may be bevelled as shown in FIGS. 1 and 2. To the nozzle device body 1, e.g., to its upper part, is connected the clamp actuator 4 which at its one end is also connected to the clamp member 3. The clamp member 3 is shaped so that it has second sealing seat surfaces 9 with a shape compatible of those of the sealing seat surfaces 8 of the nozzle device body 1 and further is aligned in regard to the nozzle device body 1 so that said sealing seat surfaces 8 and 9 will be disposed at a small distance from each other and at least essentially aligned with respect to each other.

The clamp actuator 4 is arranged to move the clamp member 3 with regard to the nozzle device body 1 so that the distance between the sealing seat surfaces 8 and 9 is adjustable and that a relatively high compressive force can be exerted thereinbetween.

The nozzle device is provided with transfer means 6 and 6' of the nozzle carrier band 5 that via the carrier band 5 are connected to each other. The band transfer means 6 and 6' are mounted so that the nozzle carrier band 5 can pass from the first transfer means 6 into the gap between the sealing seat surfaces 8 and 9 of the nozzle device body 1 and the clamp member 3 and therefrom further to the second transfer means 6'. Additionally, the edge of the nozzle carrier band 5 may have a particular perforation helping to control the location of the nozzle pieces and the movement of the nozzle carrier band 5 by means of the transfer means 6 and 6'.

The nozzle pieces 2 comprise a body part with a nozzle orifice 10 made thereto. At least the rim of the nozzle orifice 10 is made from an extremely wear-resistant material such as a ceram. In the embodiment illustrated in FIGS. 1 and 2, the nozzle pieces 2 are mounted on the nozzle carrier band 5. The nozzle pieces 2 are mounted at a constant spacing from each other and in identical positions with regard to the crossband direction of the band 5 in order to facilitate accurate positioning of the nozzle pieces 2 by virtue of the transfer means 6 and 6'. The body part of the nozzle pieces 2 is shaped so that, when the nozzle piece is pushed with the help of the clamp member 3 against the seat surface 8 of the nozzle device body 1, the nozzle piece remains compressed between the seat surfaces 8 and 9 of the nozzle device body 1 and the clamp member 3, respectively, whereby it is sealed pressure-tightly against at least one of these seat surfaces. Thus, the nozzle piece will remain tightly sealed seating, e.g., against seat surface 8 of the nozzle body 1 over the entire rim length of said surface 8 on the nozzle device body 1. The corresponding seat surfaces of the nozzle pieces 2 mating with the seat surfaces 8 and 9 are denoted in the diagrams as seat surfaces 18 and 19, respectively. Advantageously, the seat surfaces 8, 9, 18 and 19 are made conical.

In an embodiment of the method according to the invention, the replacement of the nozzle piece 2 is carried out stepwise in the following sequence:

- Coating mix infeed to the nozzle device body 1 is closed by means of a device-specific check valve (not shown).
- Operating the clamp actuator 4, compression at the nozzle piece 2 is released and the clamp member 3 is moved in regard to the nozzle device body 1 so that the seal surfaces 8 and 9 of the clamp member 3 and the nozzle device body 1, respectively, are moved sufficiently far apart from each other, thus facilitating unobstructed transfer of the nozzle piece 2 off from between said seal surfaces 8 and 9.
- The nozzle carrier band 5 is moved by the transfer means 6 and 6' for a distance equal to that of mutual distance of the nozzle pieces 2 on the carrier band 5, whereby the worn nozzle piece 2 is moved away from between the seat surfaces 8 and 9 and a new nozzle piece 2 is moved into the gap between said seat surfaces.
- With the help of the clamp actuator 4, the clamp member 3 is moved in regard to the nozzle device body 1 in such a direction and with such a force that the distance between the seal surfaces 8 and 9 of the clamp member 3 and the nozzle device body 1, respectively, are moved closer to each other, thus causing the new nozzle piece 2 located between said seal surfaces 8 and 9 to become sealed at least against one of said seal surfaces 8 or 9.
- The device-specific check valve (not shown) is opened, thus facilitating coating mix infeed to the nozzle device body 1 and therefrom further via the nozzle orifice of the nozzle piece 2 in the form of an aerosol spray to the surface of the web being coated.

Figure 3:
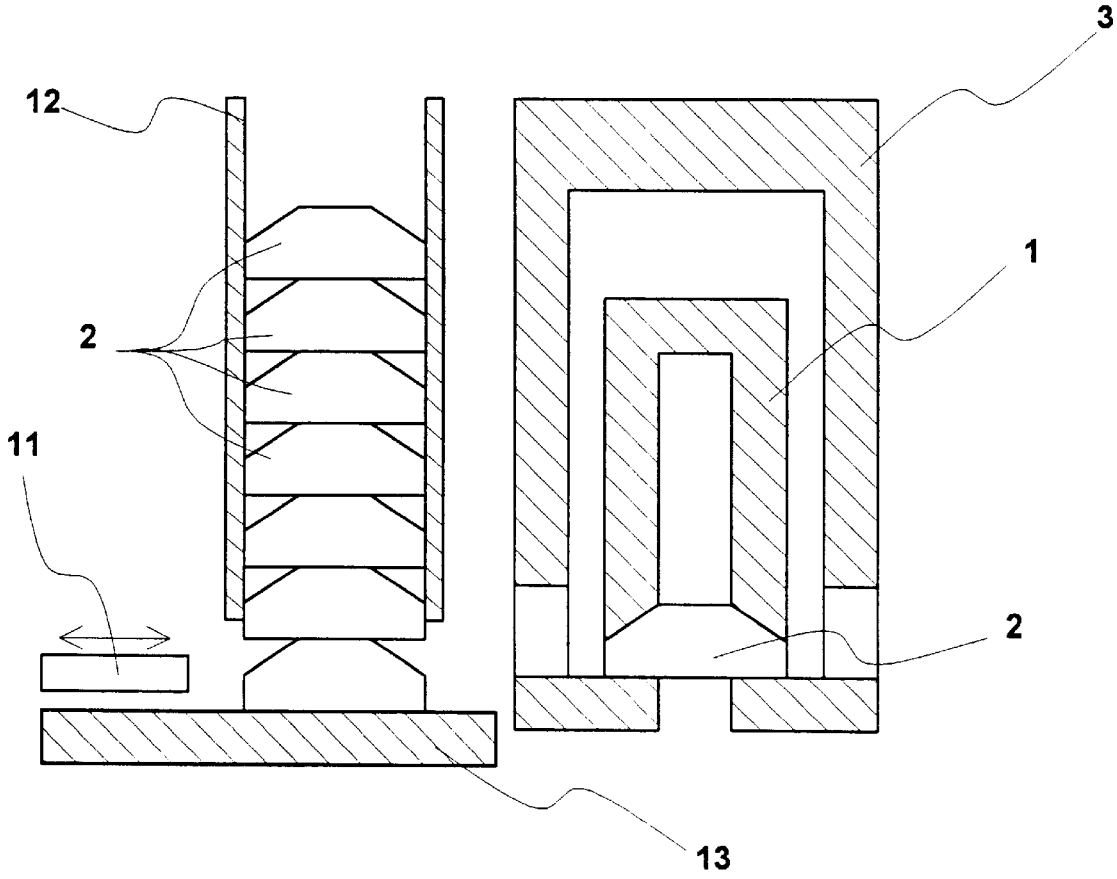
FIG. 3 shows a second embodiment of the nozzle device according to the invention for its nozzle piece related parts and in a partially sectional view.

In the embodiment shown in FIG. 3, the nozzle pieces 2 are compressed in the same manner as in the above exemplifying embodiment between the nozzle device body 1 and the clamp member 3. The actuator means required to move the clamp member 3 are omitted from the diagram of FIG. 3. In this embodiment, the nozzle pieces 2 are unconnected and they have a smooth underside. Mounted close to the nozzle device body 1, the nozzle device comprises a tubular container 12 into which the nozzle pieces 2 can be stacked. Below the tubular container 12 is mounted a support plate 13 onto which the lowermost one of the stacked nozzle pieces 2 is lowered gravitationally or, e.g., by means of a spring (not shown) mounted in the tubular container 12. With regard to the device 1 and the clamp member 3, the support plate 13 is positioned at a height that, when the gap between the clamp member 3 and the nozzle device body 1 is opened into the replacement position of the nozzle piece 2, allows an unobstructed passage of the lowermost nozzle piece 2 from the stack to replace the worn nozzle piece 2 from under the nozzle device body 1. From the stack, the lowermost nozzle piece 2 is pushed into the position under the nozzle device body 1 by means of a pusher rod 11 adapted to move immediately above the upper surface of the support plate 13. In this manner, the worn nozzle piece 2 will be displaced aside pushed by the replacing nozzle piece 2.

Figure 4:
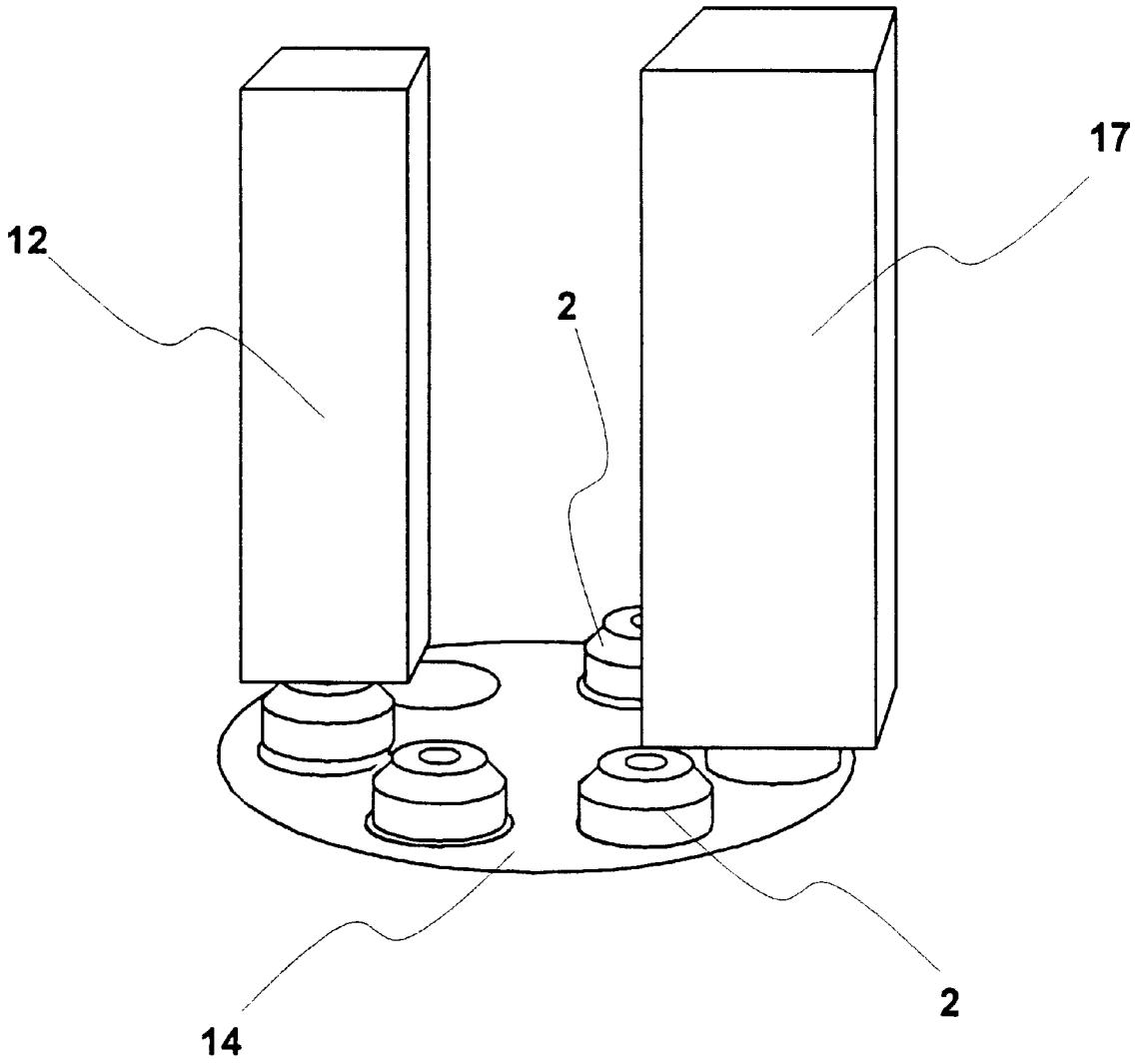
FIG. 4 shows schematically a third embodiment of the nozzle device according to the invention.

In FIG. 4 is shown an embodiment, in which the nozzle pieces 2 are unconnected and the unused nozzle pieces 2 are stacked in a tubular container 12. Between the tubular container 12 and the nozzle device 17 is adapted a rotatory disc 14 having six holes suited to support the nozzle pieces 2. In this embodiment, the replacement of the nozzle pieces 2 is carried out so that, as soon as the nozzle device 17 has released the worn nozzle piece 2, the disc 14 is rotated 60°, whereby the next nozzle piece 2 will be aligned with the sealing seat surfaces of the nozzle device body. Simultaneously, a new nozzle piece 2 will be lowered into the empty hole introduced by the rotating disc 14 under the exit end of the tubular container 12 and the worn nozzle piece is removed by means of a nozzle piece collection mechanism (not shown). The locked sealing of the nozzle piece 2 against the nozzle device body 1 and unlocking thereof, respectively, are arranged in a similar manner as described above. Also an embodiment adapted to use the disc 14 as the clamp member 3 (cf. FIGS. 1 and 2) is feasible.

In addition to those described above, alternative embodiments of the present invention may be contemplated.

An embodiment having the nozzle pieces arranged on a carrier band is shown in FIG. 1. Differently from this, the nozzle carrier band 5 with the separate nozzle pieces 2 being carried on the band may be replaced by a single rigid carrier body with the nozzle pieces 2 integrated thereon. Also along the length of such a rigid carrier body 5, the nozzle orifices are most advantageously located at a constant spacing from each other. The nozzle piece carrier body 5 may also have its edges provided with perforation or holes helping to control the location of the nozzle orifices and the movement of the nozzle carrier body 5 by means of gears, for instance.

An embodiment having the nozzle pieces 2 handled as separate pieces and the new nozzle pieces 2 arranged into a stack is shown in FIG. 3. The transfer of these nozzle pieces 2 in FIG. 3 is shown implemented using a pusher rod 11. Differently from this, the transfer of the nozzle pieces may be arranged to occur by means of, e.g., a band adapted to run under the tubular container 12 and the nozzle device body 1 and, simultaneously, above the mating surface of the clamp member 3.

Now referring to the embodiment shown in FIG. 4, an alternative possibility is to manufacture the nozzle pieces 2 as integral elements of the discs 14. In this type of embodiment, the entire disc 14 may be replaced by a new disc 14 after all the nozzle pieces 2 of the first disc 14 are worn out. Thence, the tubular container 12 would be redundant.

Thus, while there have been shown and described and pointed out fundamental novel features of the present invention as applied to preferred embodiments thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A nozzle device for use in a spray coating station for coating a paper or board web, comprising:

a nozzle device body;

a nozzle piece having a nozzle orifice, wherein said nozzle device body and said nozzle piece each have a surface adapted to mate together under a compressive force;

a nozzle piece replacement apparatus suitable for holding a plurality of said nozzle pieces, and for facilitating rapid replacement of nozzle pieces on said nozzle device body; and a clamping means for removably locking said nozzle piece tightly to said nozzle device body, said clamping means comprising;

a clamp member having a surface configured to mate with said nozzle piece; and an actuator means suitable for exerting a force to push said clamp member so that said nozzle piece becomes tightly and removably locked to said nozzle device body when the actuator means exerts the force and suitable for moving said clamp member so that said nozzle piece may be removed from said nozzle device body by said nozzle piece replacement apparatus when the actuator means does not exert the force.

2. The nozzle device of claim 1, wherein said nozzle piece replacement apparatus comprises a carrier band to which a plurality of said nozzle pieces are mounted, and a moving means for moving said carrier band.

3. The nozzle device of claim 1, wherein said nozzle piece replacement apparatus comprises a tubular container suitable for stacking a plurality of said nozzle pieces, and a transfer means for transferring stacked nozzle pieces, one at a time, to said clamping means.

4. The nozzle device of claim 3, wherein said nozzle piece replacement apparatus comprises a disc.

5. The nozzle device of claim 3, wherein said nozzle piece replacement apparatus comprises a band.

6. The nozzle device of claim 3, wherein transfer means comprises a pusher rod.

7. The nozzle device of claim 1, wherein said nozzle piece replacement apparatus comprises a disc.

8. The nozzle device of claim 1, wherein said nozzle piece replacement apparatus comprises a band.

9. The nozzle device of claim 1, wherein said nozzle piece replacement apparatus comprises a pusher rod.

10. The nozzle device of claim 1, wherein said nozzle piece replacement apparatus comprises a disc to which a plurality of said nozzle pieces are mounted, and a means for rotating said disc.

11. The nozzle device of claim 1, wherein said mating surfaces of said nozzle device body and said nozzle piece are shaped substantially as a truncated cone.

12. The nozzle device of claim 1, wherein said mating surfaces of said nozzle piece and said clamp member are shaped substantially as a truncated cone.

13. A method for replacing a nozzle piece of a nozzle device used in a spray coating station for coating a paper or board web, comprising:

removing the nozzle piece from a body of the nozzle device, wherein the nozzle piece is tightly and removably locked to the nozzle device body by a clamping means comprising a clamp member having a surface configured to mate with the nozzle piece, and an actuator means suitable for exerting a force to push the clamp member so that said nozzle piece becomes tightly and removably locked to said nozzle device body when the actuator means exerts the force and suitable for moving said clamp member so that said nozzle piece may be removed from said nozzle device body when the actuator means does not exert the force, wherein the nozzle piece is removed by releasing the force applied by the actuator means to form a gap between the nozzle piece and the clamp member, wherein removing the nozzle piece is accomplished by releasing the force exerted by the actuator means;

transferring the released nozzle piece away from the gap;

transferring a replacement nozzle piece into the gap; and causing the actuator means to exert the force so as to removably lock the replacement nozzle piece between the clamp member and the nozzle device body.

* * * * *